United States Patent [19]

McGivern, Jr.

[11] 4,324,626

[45] Apr. 13, 1982

[54] SELECTIVE REMOVAL OF NICKEL-BASED BRAZE ALLOY FROM NICKEL-BASED METALS

[75] Inventor: James F. McGivern, Jr., Avon, Conn.

[73] Assignee: United Technologies Corporation, Hartford, Conn.

[21] Appl. No.: 235,199

[22] Filed: Feb. 17, 1981

Related U.S. Application Data

[63] Continuation-in-part of Ser. No. 93,655, Nov. 13, 1979, Pat. No. 4,261,804.

[51] Int. Cl.[3] ..... C25F 5/00; C25F 3/00

[52] U.S. Cl. ..... 204/146; 204/140

[58] Field of Search ..... 204/146, 140

[56] References Cited

U.S. PATENT DOCUMENTS

| | | | |
|---|---|---|---|
| 2,549,411 | 4/1951 | Bell, III | 204/146 |
| 2,581,490 | 1/1952 | Larson | 204/146 |
| 2,596,307 | 5/1952 | Stuffer | 204/146 |
| 2,797,194 | 6/1957 | Anderson | 204/146 |
| 2,937,940 | 5/1960 | Weisberg | 75/97 |
| 3,649,489 | 3/1972 | Dillenberg | 204/146 |
| 3,694,333 | 9/1972 | Ducrot | 204/140 |
| 3,751,352 | 8/1973 | Blair | 204/145 R |
| 3,788,958 | 1/1974 | Dillenberg | 204/146 |
| 3,819,494 | 6/1974 | Fountain | 204/146 |
| 3,826,724 | 7/1974 | Riggs, Jr. | 204/146 |
| 3,886,055 | 5/1975 | Baboian | 204/146 |
| 3,892,612 | 7/1975 | Carlson | 156/150 |
| 3,900,375 | 8/1975 | Baboian | 204/146 |
| 3,943,043 | 3/1976 | Billington | 204/146 |
| 4,161,434 | 7/1979 | Quinlan | 204/146 |

OTHER PUBLICATIONS

Metal Industry, Feb. 16, 1945, p. 102.

*Primary Examiner*—T. Tufariello
*Attorney, Agent, or Firm*—Harry J. Gwinnell

[57] ABSTRACT

Nickel-based braze alloys can be removed from nickel-based metals without damaging the nickel-based metal by a process comprising immersing the nickel-based braze alloy/nickel-based metal composite into an electrolyte solution which will not attack the nickel-based metal at a specified voltage condition. This voltage condition is imposed across the composite and potentiostatically controlled to produce a nickel braze alloy/-nickel-based metal current density ratio in the composite which results in etching of the nickel-based braze alloy with no damage to the nickel-based metal. The process has particular utility for removing nickel-based alloy brazed vanes from nickel-based metal shrouds in gas turbine engine stators.

9 Claims, 4 Drawing Figures

SELECTIVE REMOVAL OF NICKEL-BASED BRAZE ALLOY FROM NICKEL-BASED METALS

This is a continuation-in-part of copending application Ser. No. 93,655, filed Nov. 13, 1979, now U.S. Pat. No. 4,261,804.

DESCRIPTION

1. Technical Field

The field of art to which this invention pertains is etching, and specifically electrochemical etching.

2. Background Art

A typical problem in removing braze alloy from brazed metal structures is the preservation of the base metal structure undamaged. This problem is complicated by the fact that more often than not the braze alloy and base metal have many elements in common. Accordingly, in trying to destroy the braze alloy there is great tendency for destroying the base metal as well. With precious metal braze alloys, the problem is readily solvable based on the knowledge that precious metal alloys have well known solubility in certain chemicals which do not attack conventional base metals such as stainless steel. This makes the selective chemical etching of precious metal-based alloy from the base metal easily attainable. However, because of the increasingly limited availability of precious metals for this purpose, it has been necessary to look to other alloy materials for brazing. Nickel-based alloys have been found to be quite an acceptable substitute. But it is well known that conventional chemical etch solutions will not etch nickel-based alloys without base metal damage, if at all. In fact, the only practical method of effecting nickel braze alloy removal from the ferrous-based metal has been electrostatic discharge machining which is extremely time-consuming and labor intensive. And, as can be readily understood, this problem is even more acute when nickel braze is used on nickel based metals.

Accordingly, what is needed in the art is an efficient method for selectively removing nickel-based braze alloy from nickel-based metals which leaves the nickel-based metal in undamaged form.

DISCLOSURE OF INVENTION

The present invention is directed to a process for the selective removal of nickel-based braze alloys from nickel-based metals while leaving the nickel-based metal in undamaged form which comprises first immersing the nickel braze alloy-nickel based metal composite into an electrolyte solution which will not attack the nickel-based metal at a specified voltage condition. Such voltage condition is next imposed across the composite and potentiostatically controlled so as to produce a nickel-braze alloy/nickel-based metal current density ratio in the composite which etches the nickel-based braze alloy without damaging the nickel-based metal.

In another aspect of the invention, a process for electrochemically removing nickel alloy braze from a nickel-based metal vane-shroud stator of a gas turbine engine without damaging the shroud is disclosed. As above, the vane-shroud composite is immersed in an electrolyte solution which will not attack the shroud at a specified voltage condition. Such voltage condition is imposed across the composite and potentiostatically controlled so as to produce a braze-shroud current density ratio in the composite which etches the braze alloy without damaging the shroud and permits mechanical removal of the vanes from the shroud also without damaging the shroud.

BEST MODE FOR CARRYING OUT THE INVENTION

Figure 1:
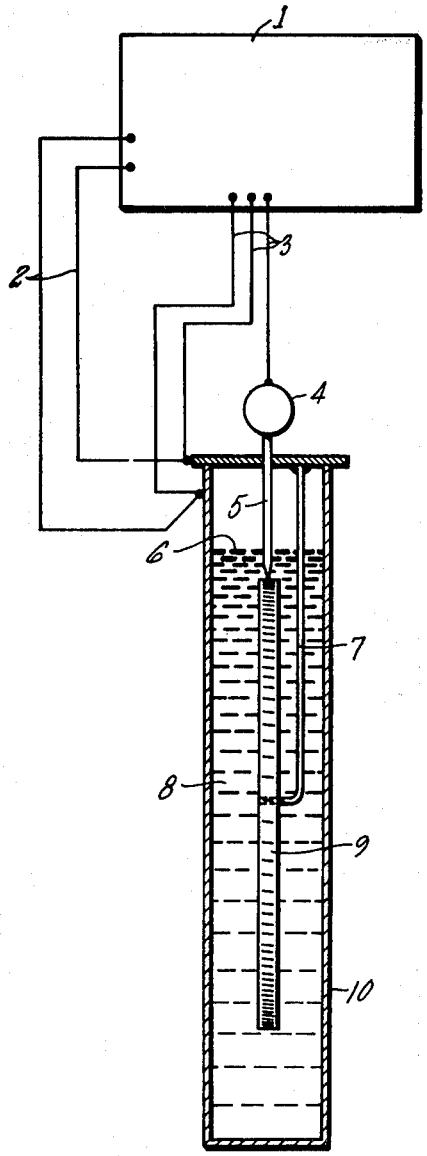
FIG. 1 shows schematically a potentiostatic setup for performing the process of the present invention.

Chemical reactions such as those involved in stripping of braze alloy and corrosion inhibition of base metals are regulated thermodynamically by the change in free energy of the reactants. These are readily discernible electrochemically by the relationship between the free energy and potentials of the reacting species in electrolytic solutions. The collection of such information is readily revealed by volt ammetry studies employing potentiokinetic techniques. In the present invention, the potential regions in which current densities were large and small in the braze alloy and base metal respectively were determined potentiokinetically in selected electrolytes. These conditions of voltage and electrolyte which resulted in low base metal current density and high alloy current density were then selected for performance of the present invention.

In this sytem, a programmable potentiostat is utilized to govern the difference in voltage between the working electrode (braze alloy-base metal composite) and a reference electrode by constraining the working electrode current density to change in response to a programmed demand for a change in the voltage difference. This allows a sweep of each individual piece to be monitored, thus assuring the proper voltage producing the proper current density in the alloy for each composite. For example, referring to FIG. 2, there are many points on the graph where the workpiece has the same current density at different voltages. If this voltage were not monitored, it is possible that the nickel-based metal could be attacked as well as the nickel braze alloy if the process were allowed to proceed based on current density alone. But by monitoring current density at a particular voltage, this possibility is eliminated.

Initial work was performed on a 3 ampere programmable Wenking Potentiostat (Elektronischer Potentiostat nach Wenking) and later work performed on a 100 ampere programmable potentiostat custom made by Hamilton Standard. While a constant voltage potentiostat could be used once the sweep or curve of a particular composite is determined, in view of the importance of avoiding any detectable attack of the shroud material, it is much preferred to use a programmable potentiostat to view the entire sweep of the composite before settling on and holding a particular voltage. The programmable potentiostat provides the ability to hold the potential of the composite constant without any reference to the operational condition of the cathode. The potentiostat measures the potential of the composite with reference to a stable electrode such as an $Hg/Hg_2SO_4$ electrode, and establishes the required nonchanging voltage with input impedance of the order of 300 megohms, and virtually no current, which might change the potential of that electrode, passing in the reference electrode loop. In the case at hand, the stainless steel tank is the cathode but the cathode can be any cathode material such as a lead plate, carbon or filament of any electrically conductive material compatible with the electrolyte. Again, as stated, a fixed point potentiostat is workable, but a potentiostat which is programmable is much more desirable in the present process because (1) the nickel-based braze alloy can be removed with a potentiostat unit with much smaller current capability since current spikes can be monitored and minimized; and (2) the whole sweep of the workpiece can be monitored and the particular potential of the workpiece can both be accurately fixed on and optimized. Furthermore, for quality control purposes the sweep of each piece may be recorded and inspected which is essential for a commercially viable process since replacement of a shroud, for example, would be an excessively expensive operation. By matching the charts for each piece, any discrepancies in recorded treatment would be readily discernable.

An essential component in the system of the present invention is the electrolyte. The electrolyte is chosen based on its effect on relative current densities which result in the nickel braze alloy and nickel-based metal when voltages are imposed across the workpiece in its presence. A variety of acids such as phosphoric acid or bases such as sodium hydroxide can be used, but sulfuric acid modified with the addition of hydrochloric acid is preferred because its good conductivity provides relatively even distribution of current density over the surfaces of irregularly shaped parts. The presence of small amounts of hydrochloric acid is necessary in order to insure that the nickel braze alloy does not become passive or become transpassive and corrode at the same potential as the nickel based metal, which would be the case if the sulfuric acid were used alone since the chemical nature of the nickel braze alloy and nickel-based metal are so similar. The addition of the HCl in the $H_2SO_4$ system while making it more difficult to passivate the nickel-based metal, has an even greater effect in prevention of passivation of the nickel braze alloy, although narrowing the passive-transpassive voltage window for the system may be expected and the demands on the potentiostat for control potential accuracy increased. While the sulfuric-hydrochloric acid system is preferred, other electrolyte systems recited above can be modified accordingly to produce similar results, e.g. if phosphoric acid were used, a hydrofluoric acid modifier might be chosen, etc. If too little of the modifying acid (e.g. HCl) is used, braze removal with base metal safety could become too slow to be practical, especially in a commercial sense. If too much is used, more than preferential attack of the braze will take place. Accordingly, about 0.5% to 5% (by volume) of the modifying acid (HCl) is preferably used with about 4% to about 6% of the $H_2SO_4$, with about 5% $H_2SO_4$ and 1.5% HCl being most preferred at voltages of 0.7 to 0.9 and preferably 0.85 to 0.9 volt. Also, the decomposed braze alloy components, such as the nickel, form soluble species when reacted with mixed acids under the conditions of the present invention enabling their removal from the reaction site permitting, therefore, unimpeded progress of the process. For example, an electrolyte which resulted in the precipitation of the braze alloy decomposition components in addition to restricting the life of the bath would tend to form undesirable deposits on the workpiece as well. For similar reasons, complex-forming electrolytes such as ammonia-, cyanide- and phosphate-, etc., containing electrolytes are also contemplated. From experiments with similar systems, it appears that of the electrolytes tested, NaOH modified with the addition of chloride ions would permit the most quantitative current density separation. However, the time factor for braze removal makes the sulfuric acid-hydrochloric acid system the better choise. The sulfuric acid-HCl system appears to remove the braze at a faster rate without any detectable nickel-based metal attack per time of braze removal.

Two determinative factors for selecting concentration of electrolyte in the braze removal solution are (1) sufficient electrolyte to provide the requisite conductivity to impose the desired voltage uniformly across the workpiece, but (2) without attacking the nickel-based metal substrate at such voltage. In the case of the hydrochloric acid modified sulfuric acid, aqueous solutions of from about 4% to about 6% by volume sulfuric acid modified with from about 0.5% to about 5% by volume hydrochloric acid are preferred. The preferred solution produces a pH of about 1, but pH strength itself is not a critical factor. For each pH unit change, there is a voltage shift of approximately 0.06 volt. However, as can be seen from the figures, the key parameter in the process of the present invention is not the percents of components or specifc voltage or current densities, but rather the most favorable ratio of braze attack versus nickel-based metal attack. This is measurable as relative current densities or ratio of current densities for a particular voltage. See FIG. 3.

A stator to be overhauled was processed according to the present invention as follows. The stator was cleaned to remove engine soots which might unnecessarily contaminate the process electrolyte. The stator thus cleaned is then suspended statically in a water solution of 5% sulfuric acid-1.5% HCl as shown schematically in FIG. 1. A programmable potentiostat is next utilized to impose a voltage of approximately 0.85 volt in the cathodic sense on the workpiece versus the mercury/-mercuric sulfate reference electrode. This is done for 30 to 60 seconds to hydrogen flush the workpiece surface providing a further cleaning. Voltage is brought back to 0 and polarity reversed to begin the selective nickel-alloy braze removal. The workpiece is potentiokinetically swept anodically on a linear ramp at 50 millivolts per minute to 0.85 volt ($\pm$0.01 volt) versus the reference cell and held at this potential potentiostatically for the duration of the stripping cycle. For the vanes and stator used in this example, this was approximately 16 hours. Following this, the power is turned off and the stator is rinsed and dried. Silicon carbide or other grit blast is used to dislodge braze alloy degraded components. At this point, braze filters and braze overrun are completely removed and stripping can be detected in the crevices between the vanes and shrouds. While in some cases this single treatment may be sufficient to permit simple mechanical removal of the vanes, it is more likely that the steps will have to be repeated at least one more time. In this particular example, extensive stripping in the crevices between the vanes and shroud developed after a second run. The braze alloy remaining gas quite porous, badly weakened and in some locations light could be seen between the vanes and the shrouds at the joints. At this point, the vanes were removed with hydraulic press and dies after grinding of the stakes and tack welds used for temporary structure alignment during manufacture prior to and during brazing. The process can be repeated further after vane removal to reduce residual braze alloy sufficient to facilitate insertion of new vanes into the treated shroud.

While this process of the present invention may be used on nickel-based metals which comprise either an alloy such as Inconel 750 or Inconel 600 alone, the process may also be used on structures comprising a combination of such alloys, for example, on typical box shroud structures with inner and outer shroud materials of Inconel 750 and an outer shroud cap of Inconel 600.

Figure 4:
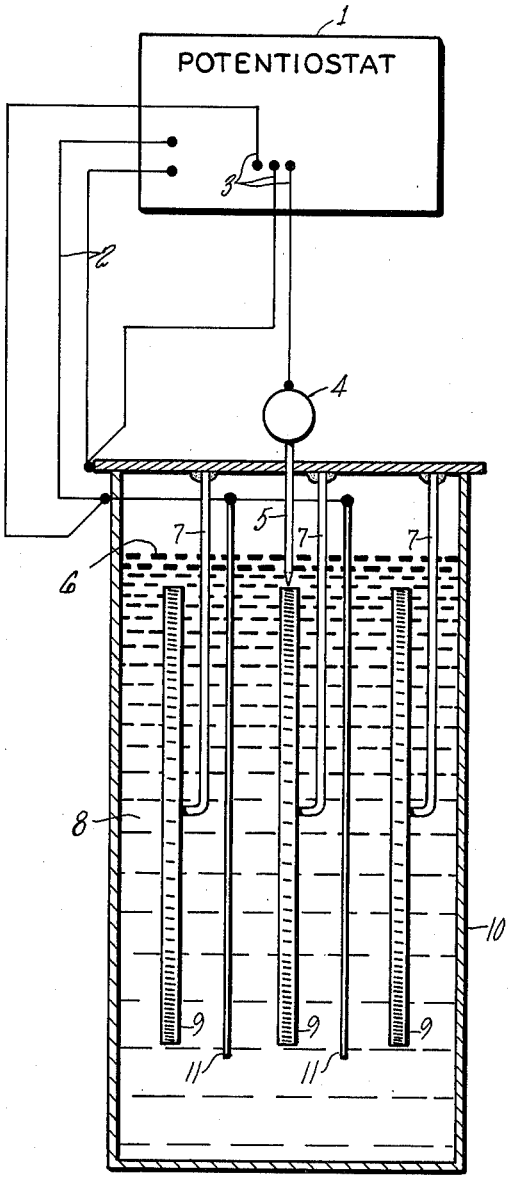
FIG. 4 shows schematically a potentiostatic setup for performing the process of the present invention on a multiplicity of stators simultaneously.

As evidenced by this example, the method described represents a significant advance in this art with substantial savings of labor effort. While the total stripping time may be typically 32 hours, the setup and process operation for a multiplicity of stators (e.g. a rack of 3 stators as shown in FIG. 4) may require operator attention of only 30 minutes. This is in major contrast to conventionally used processes which would be necessary to remove nickel-containing braze alloys from nickel-based metal composites such as electrostatic discharge machining which may require 24 or more labor intensive hours to accomplish the same result for a single stator.

A closer inspection of the accompanying figures will help to better understand the invention and underscore its advantages. FIG. 1 shows schematically apparatus useful in the performance of the present invention. In the figure, the potentiostat is indicated as 1, with power leads 2 and sensing leads 3. The reference electrode is indicated as 4 and Luggin capillary and acid bridge 5. The electrolyte level 6 of the electrolyte solution 8 is maintained sufficiently high in tank 10 so as to completely cover the stator 9 suspended in the electrolyte by hanger 7. The hanger should preferably be made of the same material as the nickel-based metal in order to avoid the formation of local galvanic corrosion cells which might damage stator components or shorten hanger working life.

Figure 2:
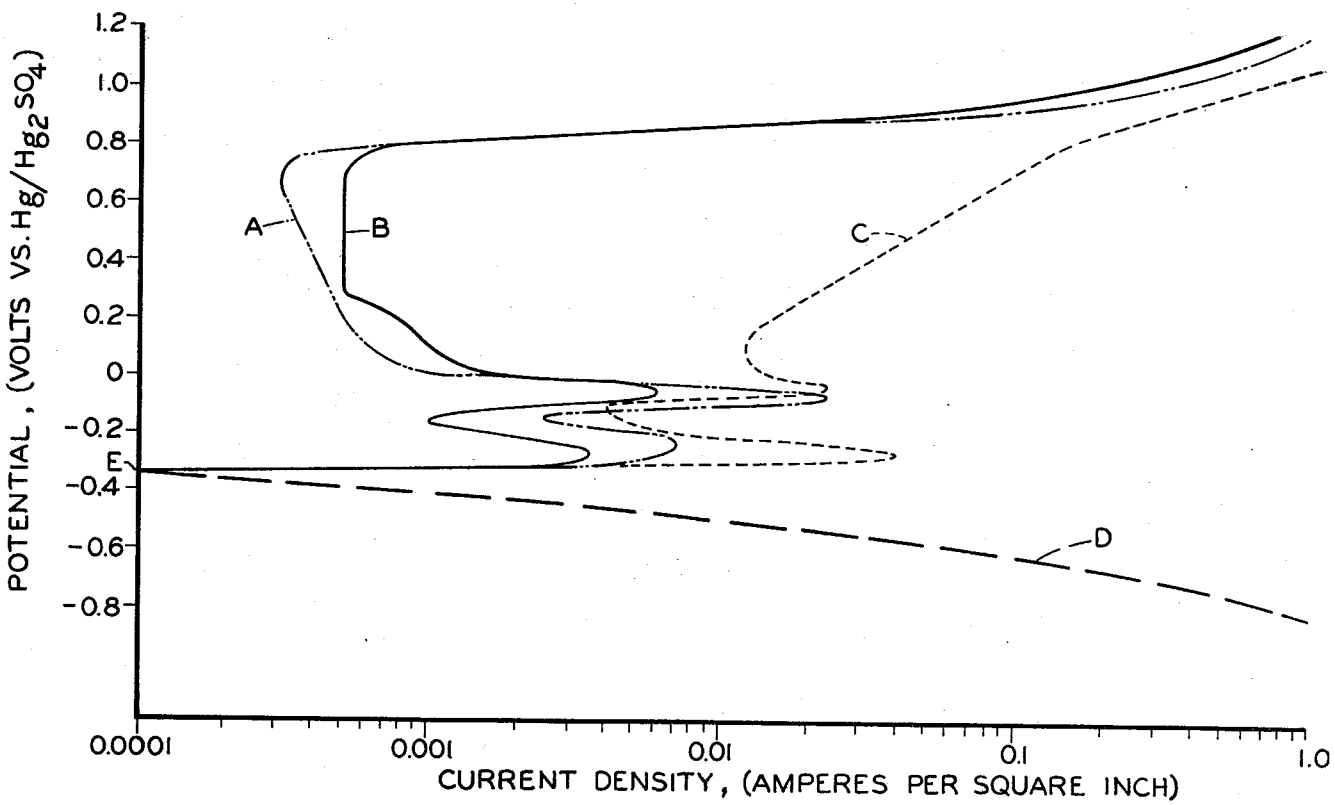
FIG. 2 is a graphic representation of current density in various nickel alloys of the present disclosure as a function of voltage.
Figure 3:
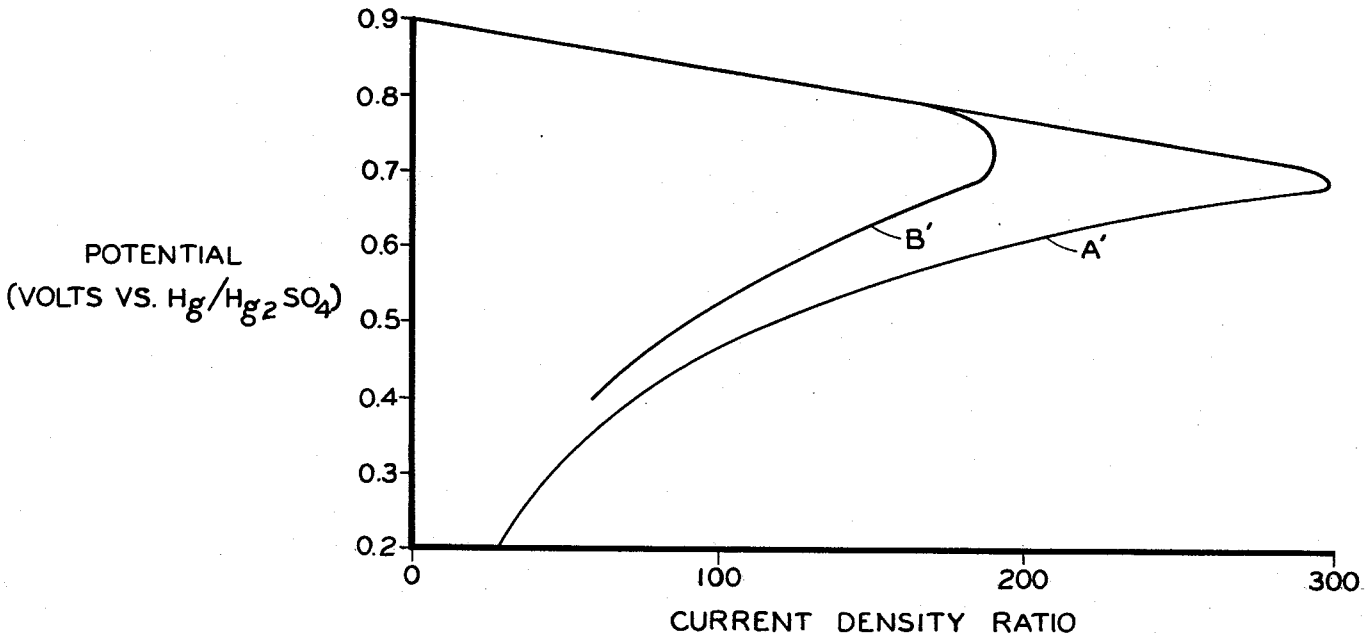
FIG. 3 demonstrates current density ratios of various nickel-based metal surfaces of the present invention as a function of voltage.

FIG. 2 demonstrates the current density of a typical nickel-based braze alloy as a function of voltage imposed across the alloy. In FIG. 2, curves A and B represent the polarization curves for typical nickel-based metals according to the present invention (Inconel 600 and Inconel 750, respectively) and curve C, the polarization curve for a typical braze alloy according to the present invention (AMS 4777). From FIG. 1, the polarization of Inconel 750, Inconel 600 and AMS 4777 were performed in a 5% sulfuric acid solution in water containing 1.5% hydrochloric acid at a temperature of 75° F. (24° C.). The rate of potential scan was 65 millivolts per minute and the reference electrode was mercury/-mercuric sulfate. Curve D represents the common cathodic responses of curves A, B and C. Curve D up to point E represents the measure of the current density as the voltage on the above materials is increased from about −0.85 volt to the transition point (E) where the current changes from cathodic to anodic (about 0.35 V). As can be seen from the graph, at this point the current densities become specific for the three materials. This portion of the graph also demonstrates that the relative "nobility" of the metals is unimportant for successful operation of the process according to the present invention, since as demonstrated by curve D and point E, their relative nobilities are about equal. FIG. 3 is a graph of the current density ratios as calculated from FIG. 2 based on (i=current density) nickel-based metal/nickel braze alloy. While it appears from FIG. 3 that the optimum performance of the system occurs at 0.7 to 0.75 volts, in actual testing, this range has been found to be 0.85 to 0.9. This is attributable to the fact that the data is based on a scan rate of 65 millivolts per minute, whereas in actual operation, an effective scan rate of 0 volts per minute prevailing during potentiostatic phase succeeding the potentiokinetic sweep is used. The potentiostatic phase of the operation which characterizes the main bulk of the total stripping time produces no instrument lag time and extends the upper potential passivity limits to higher voltage.

In the samples tested, the nickel braze alloy had a composition comprising by weight about 4.5% silicon, about 7.0 chromium, about 3.0% iron, about 3.1% boron, and about 82.4% nickel (AMS 4777). The nickel-based metals tested comprised about 15.5% chromium, 2.5% titanium, 0.95% columbium plus tantalum, 0.7% aluminum, 7% iron and 73.35% nickel (Inconel 750) and 15.5% chromium, 8.0% iron and 76.5% nickel (Inconel 600). It should be noted, however, that the present invention is not limited to these particular nickel-based braze alloys or nickel-based metal but will similarly perform on other nickel braze alloy-nickel-based metal composites as well. It should also be noted that while the scope of investigation of the present invention centered on the removal of nickel-based braze alloy from nickel-based metal, there is no reason to expect that the present process would not work equally as well on other braze-base metal systems with discernable corrosion rate differences such as, e.g. brass braze-copper based metal, aluminum braze-aluminum alloy, etc. And, of course, the system of the present invention can be used to remove braze alloy from more or less noble substrate metals. For example, an 82% gold-18% nickel (by weight) braze has been removed from the above nickel based metals by the process according to the present invention. Conventionally, such braze has been removed with various acid or alkaline electrolytes and ultrasonic energy. The potentiostatic method according to the present invention can also be combined with such ultrasonic method to reduce treatment time of even this conventional method.

By viewing FIGS. 2 and 3 together, it is apparent that by selecting a voltage between approximately 0.7 and 0.9, the ratio of current density in the braze alloy is approximately 80 to 300 times that present in the nickel-based metal, which would clearly preferentially etch the braze alloy composition in a reasonable amount of time. The polarogram of the referenced FIG. 2 was produced by voltage ramp of about 0.065 volt per minute. Under potentiostatic (no voltage ramp) conditions, the ultimate passivity of the nickel-based metal proceeds well into the selected operational voltage range so that the actual working current density ratio is probably substantially higher than would be indicated from inspection of FIGS. 2 and 3.

In the potential region of 0.7 to 0.9 volt, the current density of the nickel-based metals is approximately 0.0025 ampere to 0.0003 ampere per square centimeter. At the same potential, the nickel-based alloy current density is approximately 0.2 ampere to 0.09 ampere per square centimeter. The current density ratio is therefore, 80 to 1 to 300 to 1. At this potential, therefore, the corrosion of nickel alloy braze would be approximately 80 to 300 times that of nickel-based metal, clearly an effective separation of the two materials.

It will also be understood that the current electrode must be disposed in the cell in such a way as to provide the current density demanded by the controlled potential applied. In a system such as this where one component is passivated-virtually shut off electrically—this electrode disposition is not difficult to achieve even on hardware of complex configuration. For example, in FIG. 1, the stator is shown symmetrically disposed, whereas slight offset from center would not be a problem. In this system, great preponderance of electrical current seeks the more corrodible species. It can further be arranged that the counter electrode may serve additionally as a cathodic collector of components of the braze alloy removed. This would especially apply to nickel in the present invention, but could be applied to precious metal braze alloy as well.

As may be appreciated from inspection of FIG. 4, it has been found possible to process a multiplicity of stators simultaneously by: (a) enlargement of the cell, and (b) suitable interposition of additional current (auxilliary) electrodes (11) such that the spatial arrangement of each stator relative to its auxilliaries is like that of FIG. 1 for single stator treatment. One may view the setup of FIG. 4 as one in which one stator is used as control for common processing of all. In this Figure, as in FIG. 1, the potentiostat is indicated as 1, with power leads 2 and sensing leads 3. The reference electrode is indicated as 4 and Luggin capillary and acid bridge 5. The electrolyte level 6 of the electrolyte solution 8 is maintained sufficiently high in tank 10 so as to completely cover the stators 9 suspended in the electrolyte by hanger 7.

It will further be appreciated that, while all stators to be processed simultaneously may be paralleled throughout the entire program provided the potentiostat is large enough, with a potentiostat of limited power, it is still possible to treat a multiplicity of stators which at certain times during the program would overload the potentiostat. This is done by sequential addition of stators after the first one has been ramped to approximately 0.35 volts, i.e. after the first one is over its current density maximum and is, with exception of braze alloy, passivated. When this is done, addition of each successive stator is accompanied by a current spike of relatively short duration to the extent of approximately the peak current density for one during operation of the program. It has been found possible to process as many as ten stators of the sizes commonly encountered in jet engines simultaneously in this way, on a 100-ampere potentiostat, whereas the peak current for each one might typically be 60 amperes. Similarly, the process can be operated continuously. Inasmuch as stators may be added in this manner, they can be similarly removed and replaced by other stators while the process is running without interruption at the controlled voltage. Each removal will be accompanied by a small current reduction and each addition subject to the current spike recited above in the sequential addition of stators.

Although it is seldom practiced, it will similarly be realized that once the most desirable potential preset for a given stator is known, the programmed ramp may be avoided altogether and the stators, including the first one, may be started abruptly at a potential somewhat inferior to the final control potential and the multiplicity ramped to the control potential together as a group, after which time braze removal proceeds identically as with single stator processing.

Although the invention has been shown and described with respect to exemplary embodiments thereof, it should be understood by those skilled in the art that the foregoing and various other changes, omissions and additions may be made therein and thereto, without departing from the spirit and the scope of the invention.

I claim:

1. A process for the selective removal of nickel-based braze alloy from nickel-based metal/nickel-based alloy composites comprising immersing at least one composite in a solution of electrolyte comprising 4% to 6% by volume sulfuric acid and about 0.5% to 5% by volume hydrochloric acid which is substantially non-corrosive to the nickel-based metal at voltages of 0.7 volt to 0.9 volt, imposing such voltage across the composite and potentiostatically controlling such voltage while the composite is immersed in the electrolyte producing a nickel braze alloy/nickel-based metal current density ratio in the composite which selectively etches the nickel-based metal.

2. A process for electrochemically removing nickel alloy brazed vanes from nickel-based metal shrouds in gas turbine engine stator composites comprising immersing at least one vane-shroud composite in an electrolyte solution comprising 4% to 6% by volume sulfuric acid and about 0.5% to 5% by volume hydrochloric acid which is non-corrosive to the shroud at voltages of 0.7 to 0.9 volt, imposing such voltage across the vane-shroud composite and potentiostatically controlling such voltage so as to produce a ratio of braze to shroud current density which selectively etches the nickel alloy braze with no damage to the shroud until the braze is sufficiently broken down to permit mechanical removal of the vanes from the shroud without damage to the shroud.

3. The process of claims 1 or 2 wherein the voltage is controlled by means of a programmable potentiostat.

4. The process of claims 1 or 2 wherein the electrolyte is a 5% by volume sulfuric acid and 1.5% by volume hydrochloric acid in water.

5. The process of claims 1 or 2 wherein the nickel-based braze alloy comprise by weight about 4.5% silicon, about 7% chromium, about 3% iron, about 3.1% boron and about 82.4% nickel.

6. The process of claims 1 or 2 wherein the nickel-based metal comprises by weight about 15.5% chromium, 2.5% titanium, 0.95% columbium plus tantalum, 0.7% aluminum, 7% iron, and 73.35% nickel; about 15.5% chromium, 8.0% iron, and 76.5% nickel; or combinations thereof.

7. The process of claims 1 or 2 wherein the current density ratio is at least 80 to 1.

8. The process of claims 1 or 2 wherein the voltage is 0.85 to 0.9 volt.

9. The process of claims 1 or 2 wherein at least two composites are processed simultaneously.

* * * * *